US011152714B2

(12) United States Patent
Jakoby et al.

(10) Patent No.: US 11,152,714 B2
(45) **Date of Patent: *Oct. 19, 2021**

(54) ELECTRONICALLY STEERABLE PLANAR PHASE ARRAY ANTENNA

(71) Applicant: ALCAN Systems GmbH, Darmstadt (DE)

(72) Inventors: Rolf Jakoby, Rosbach (DE); Onur Hamza Karabey, Neu-Isenburg (DE); Felix Goelden, Berlin (DE); Atsutaka Manabe, Bensheim (DE)

(73) Assignee: Alcan Systems GmbH, Darmstadt (DE)

( * ) Notice: Subject to any disclaimer, the term of this patent is extended or adjusted under 35 U.S.C. 154(b) by 80 days.

This patent is subject to a terminal disclaimer.

(21) Appl. No.: 16/402,395

(22) Filed: May 3, 2019

(65) Prior Publication Data

US 2019/0260139 A1 Aug. 22, 2019

Related U.S. Application Data

(63) Continuation of application No. 14/347,717, filed as application No. PCT/EP2012/067767 on Sep. 12, 2012, now Pat. No. 10,320,089.

(30) Foreign Application Priority Data

Sep. 27, 2011 (EP) ..... 11182926

(51) Int. Cl.
*H01Q 21/06* (2006.01)
*H01Q 1/38* (2006.01)
(Continued)

(52) U.S. Cl.
CPC ..... *H01Q 21/061* (2013.01); *H01Q 1/38* (2013.01); *H01Q 1/44* (2013.01); *H01Q 3/34* (2013.01);
(Continued)

(58) Field of Classification Search
CPC ..... H01Q 21/061; H01Q 21/065; H01Q 3/34; H01Q 21/0087; H01Q 1/38; H01Q 1/44; H01Q 3/44; Y10T 29/49018
(Continued)

(56) References Cited

U.S. PATENT DOCUMENTS 5,537,242 A 7/1996 Lim
5,936,484 A 8/1999 Dolfi et al.
(Continued)

FOREIGN PATENT DOCUMENTS

CN 1373916 A 10/2002
CN 1728448 A 2/2006
(Continued)

OTHER PUBLICATIONS

Office Action in corresponding Japan appln. No. 2014-532307 dated Apr. 20, 2017.
(Continued)

*Primary Examiner* — Peter M Bythrow
(74) *Attorney, Agent, or Firm* — Millen, White, Zelano & Branigan, P.C.; William Nixon

(57) ABSTRACT

A two-dimensional (2-D) beam steerable phased array antenna is presented comprising a continuously electronically steerable material including a tunable material or a variable dielectric material, preferred a liquid crystal material. A compact antenna architecture including a patch antenna array, tunable phase shifters, a feed network and a bias network is proposed. Similar to the LC display, the proposed antenna is fabricated by using automated manufacturing techniques and therefore the fabrication costs are reduced considerably.

18 Claims, 5 Drawing Sheets

(51) Int. Cl.

| | |
|---|---|
| ***H01Q 1/44*** | (2006.01) |
| ***H01Q 3/44*** | (2006.01) |
| ***H01Q 3/34*** | (2006.01) |
| ***H01Q 21/00*** | (2006.01) |

(52) U.S. Cl.
CPC ..... *H01Q 3/44* (2013.01); *H01Q 21/0087* (2013.01); *H01Q 21/065* (2013.01); *Y10T 29/49018* (2015.01)

(58) Field of Classification Search
USPC ..... 342/368
See application file for complete search history.

(56) References Cited

U.S. PATENT DOCUMENTS

| | | | | |
|---|---|---|---|---|
| 6,377,217 | B1 | 4/2002 | Zhu et al. | |
| 6,864,840 | B2 * | 3/2005 | Zhu | H01P 1/181 343/700 MS |
| 7,361,288 | B2 | 4/2008 | Lussem et al. | |
| 7,466,269 | B2 | 12/2008 | Haziza | |
| 7,884,766 | B2 | 2/2011 | Haziza | |
| 10,320,089 | B2 * | 6/2019 | Jakoby | H01Q 3/34 |
| 2002/0126048 | A1 | 9/2002 | Zhu et al. | |
| 2005/0067605 | A1 | 3/2005 | Lussem et al. | |
| 2005/0068123 | A1 | 3/2005 | DeNatale | |
| 2008/0036664 | A1 | 12/2008 | Haziza | |
| 2009/0091500 | A1 | 4/2009 | Haziza et al. | |
| 2009/0278744 | A1 | 11/2009 | Kirino et al. | |

FOREIGN PATENT DOCUMENTS

| | | | |
|---|---|---|---|
| CN | 101283480 | A | 10/2008 |
| CN | 101454941 | A | 6/2009 |
| DE | 102004029429 | A1 | 2/2005 |
| EP | 2020051 | B1 | 2/2009 |
| JP | S58093002 | U | 6/1983 |
| JP | S60068701 | U | 5/1985 |
| JP | H077303 | A | 1/1995 |
| JP | H10145103 | A | 5/1998 |
| JP | 2000315902 | A | 11/2000 |
| JP | 2002330006 | A | 11/2002 |
| JP | 2005064632 | A | 3/2005 |
| JP | 2007110256 | A | 4/2007 |
| JP | 2009538565 | A | 11/2009 |
| WO | 9626554 | A1 | 8/1996 |
| WO | 2011036243 | A1 | 3/2011 |

OTHER PUBLICATIONS

English machine translation of JP2005064632A issued on Mar. 10, 2005 to Kuki Takao of Japan Broadcasting Corp.
English machine translation of JP2002330006A issued on Nov. 15, 2002 to Kuki Takao of Japan Broadcasting Corp.
English machine translation of JP2000315902A issued Nov. 14, 2000 to Kuki Takao of Japan Broadcasting Corp.
Guerin et al., "Modeling, Synthesis and Characterization of a Millimeter-Wave Multilayer Microstrip Liquid Crystal Phase Shifter" Japanese Journal of Applied Physics, vol. 36, Part 1, No. 7A pp. 4409-4413(1997).
International Search Report for PCT/EP2012/067767 dated Oct. 17, 2012.
Karabey, O. H. et al., "Electronically beam steerable planar phased array antenna integrated with liquid crystal based phase shifters," Journal of Latex Class Files, Jan. 2007, vol. 6, No. 1.
English Abstract of WO2011036243, Publication Date: Mar. 31, 2011.
Office Action for related Chinese Patent Application No. 201280058131.4 dated Oct. 14, 2016.
English Abstract for CN1728448, Publication Date: Feb. 1, 2006.
English Abstract for CN101283480, Publication Date: Oct. 8, 2008.
English Abstract for CN101454941, Publication Date: Jun. 10, 2009.
English Abstract for JP2007110256, Publication Date: Apr. 26, 2007.
English Abstract of JPH077303, Publication Date: Jan. 30, 1995.
English Abstract of JP60068701U, Publication Date: May 15, 1985.
English Abstract of JP58093002; Publication Date: Jun. 2, 1983.

* cited by examiner

FIG. 4a
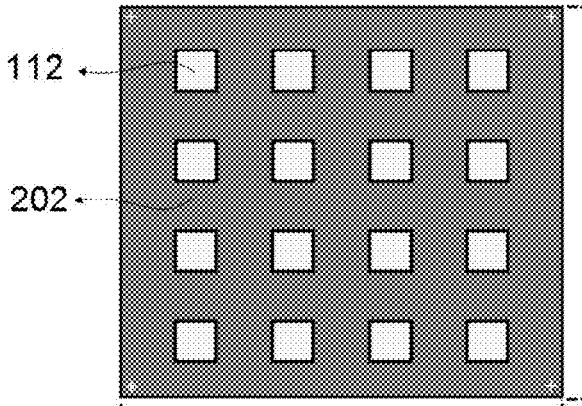
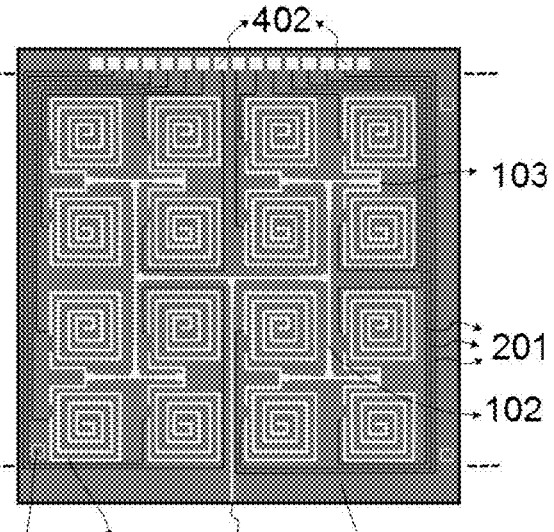
FIG. 4c
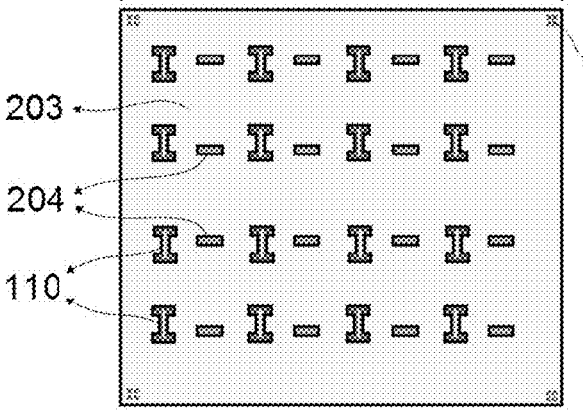
FIG. 4b
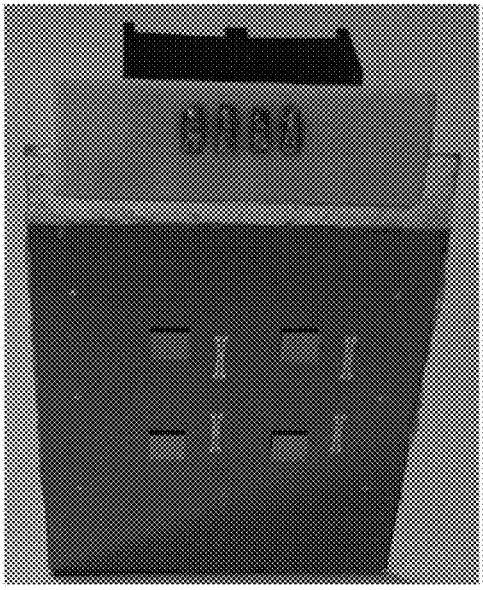
FIG. 5a
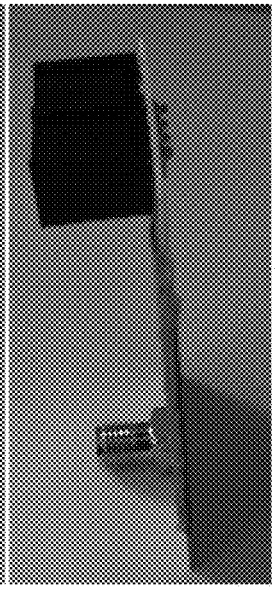
FIG. 5b
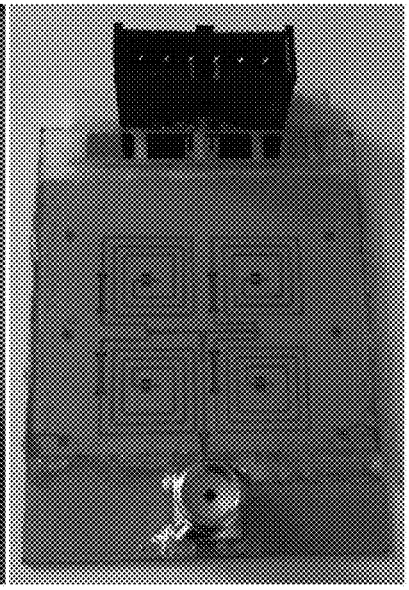
FIG. 5c

ELECTRONICALLY STEERABLE PLANAR PHASE ARRAY ANTENNA

A two-dimensional (2-D) beam steerable phased array antenna is presented comprising a continuously electronically steerable material including a tunable material or a variable dielectric material, preferred a liquid crystal material. A compact antenna architecture including a patch antenna array, tunable phase shifters, a feed network and a bias network is proposed. Similar to the LC display, the proposed antenna is fabricated by using automated manufacturing techniques and therefore the fabrication costs are reduced considerably.

STATE OF THE ART

This invention relates to a phased array antenna. More specifically, the invention relates to an electronically steerable phased array antenna based on voltage tunable phase shifters whose low loss dielectric material can be tuned with an applied voltage.

In recent years, demand for steerable antennas increased dramatically for mobile terminals due to the rapid development of broadcast satellite services. Wireless internet, multimedia and broadcasting services are provided from satellites, which operate at L-band, Ku-band or K/Ka-band by steerable antennas, e.g. to a moving vehicle such as an automobile or airplane or ship or even other portable devices like mobile TV or GPS.

A steerable antenna can change its main beam direction in order to ensure that the main beam is continuously pointing towards the satellite. Most of the steerable antennas in the market are mechanically controlled. By the help of mechanical systems, which are driven by motors, the orientation of the antenna is adjusted in the elevation and azimuth planes. Some other types of antenna systems utilize hybrid methods like electronically steering in the elevation plane and mechanical adjustment in the azimuth plane. These kinds of mobile terminals are bulky, have relatively slow beam steering speed, i.e. 45°/s, sensitive to the gravitational force and require high maintenance costs since the mechanical systems are used. They are mainly used in military application and not preferred for a mobile terminal for which the aesthetic appearance is a critical requirement, i.e. for automobile industry.

A phased array antenna is one of the well-known types of the electronically steerable antennas (ESA) which is fast, compact, reliable and easy to maintain compared to mechanically steerable ones. It consists of RF feed/distribution network, electronically tunable phase shifters, transmit/receive modules (for active arrays) and radiating elements. The phase of each radiating element or group of radiating elements is/are adjusted to predefined phase values by the electronically tunable phase shifters in order to tilt the radiated phase front in a specified direction. These antennas are low-weight and low-profile whereas the challenge is high price of the respective terminal due to its expensive electronics.

Electronically tunable phase shifters play an essential role concerning the performance, cost, and dimensions of the ESA. The common parameter for quantifying the RF performance of a tunable phase shifter is a frequency dependent figure-of-merit (FoM) of the phase shifter. It is defined by the ratio of the maximum differential phase shift and the highest insertion loss in all tuning states. In general, the aim is to achieve the highest possible differential phase shift accompanied by the lowest insertion loss which leads to a high FoM. In art, technological approaches for electronically tunable phase shifters include micro-electromechanical systems (MEMS), semiconductors and continuously tunable dielectrics such as barium strontium titanate (BST) and liquid crystal (LC). These technologies have been compared in terms of different aspects such as tunability, power consumption, response time and cost. The state of the art FoM of MEMS based phase shifter is about 50°/dB to 100. VdB. Semiconductor based monolithic microwave integrated circuit (MMIC) phase shifters have FoM around 40°/dB to 70°/dB at microwave frequencies >20 GHz. Similarly, BST based phase shifters have relatively high performance (FoM is about 40°/dB to 90°/dB) for frequencies up to 10 GHz.

Liquid Crystal (LC) is another possible tunable dielectric which can be used for high micro and millimeter-wave applications. LC is a continuously tunable material with low dielectric losses. In practical application, its tenability can be controlled, i.e. applying a bias voltage with low power consumption. Its tunability is defined as the fractional change in the dielectric constant with an applied voltage. Effective dielectric constant of LC depends on the orientation of the molecules with respect to the RF-field. Desired orientation of the molecules, i.e. parallel or perpendicular to the RF-field, can be accomplished by using surface treatments or electrostatic field. The FoM of a microstrip line based LC phase shifter of the state of the art is about 110°/dB and of a partially filled waveguide based LC phase shifter is 200°/dB at 20 GHz.

A low-profile, two dimensional steerable array can be fabricated in "tile" architecture where the electronically tunable phase shifters are mounted on another layer which is parallel to the radiating elements. For such a large array, i.e. with 16×16 radiating elements, compactness of the electronically tunable phase shifters become an issue. Each phase shifter or group of phase shifters has to be fabricated on a limited area. Moreover, they have to be biased individually in order to steer the antenna main beam both in elevation and azimuth planes. MEMS or semiconductor based phase shifter needs more than one bias line depending on its differential phase shift resolution. For instance, a 3-bit phase shifter has to be biased with three bias lines. On the other hand, only one bias line is required when a tunable dielectric based phase shifter is used. However, compact design of an electrically tunable phase shifter which has a 360° differential phase shift, is still challenging.

Additionally, due to a compact design of a large ESA, coupling between the electronically tunable phase shifters and other components has to be prevented in order not to reduce the antenna performance. In US20090091500 possible usage of LC for antennas is given. However, practical problems such as biasing the tunable phase shifters individually and feeding the RF signal to the antenna have not been discussed. Additionally, particular attempts have been done within the scope of the present invention in order to design compact phase shifters and to prevent undesired coupling between the radiating elements and feed network. Similarly, other variable dielectric based antenna arrays are discussed in U.S. Pat. Nos. 6,759,980, 6,864,840, however, there the individual phase shifters for each antenna element have to be mounted element by element to different substrates. The present invention integrates the phase shifters in the uniform substrates and furthermore allows the use of liquid tunable dielectrics.

U.S. Pat. No. 7,361,288 and WO 2011/036243 disclose Components for High-Frequency Technology utilizing liquid crystals as steearable dielectrics. However, this is not a planar device. Such phase shifters as described in these patent documents can not be used in order to fabricate a low profile antenna.

Special liquid crystals developed for application in high-frequency technology are disclosed e.g. in WO 2011/009524 and WO 2011/035863.

Advantage of the Invention

Low-cost, lightweight, electronically steerable phased arrays which can be fabricated by using automated manufacturing techniques are of interest for mobile terminals such as for automobiles, airplanes and radars. The antennas main beam direction can be continuously steerable in order to provide the services, e.g. wireless internet or broadcasting, simultaneously on moving vehicles via satellite. Planarity and aesthetic appearance of the antenna with low-profile has to be maintained since these are other critical issues, i.e., for automobile industry. Such an antenna requires compact, low loss, electronically tunable phase shifters which can be integrated to the radiating elements and feeding network. A biasing network is necessary by which all phase shifters can be biased individually. Such an electronically steerable antenna is subject of the invention.

SUMMARY OF THE INVENTION

This invention provides a low profile, electronically steerable, planar phased array antenna whose main beam can be continuously steerable in one or two dimensions. The antenna comprises an input, feed network, at least one power divider (combiner), at least one electronically tunable phase shifters, a biasing network and at least two radiating elements. The electronically steerable phased array antenna comprises a stack of at least three dielectric substrates, preferred uniform dielectric substrates, at least two of which are solid and can carry a plurality of electrodes. An individual element of the array antenna comprises at least an electronically tunable phase shifter, a biasing network and a radiating element. The phase shifter electrodes are grouped in order to form the plurality of individual antenna elements whereas a single uniform substrate can carry electrodes for any number of antenna elements. The substrates may furthermore carry electrodes for the feed network. A continuously variable dielectric being either liquid or solid is sandwiched by two of the aforementioned solid dielectric substrates. Electronically tunable phase shifters utilizing the variable dielectric substrate are thereby integrated into the antenna. The dielectric constant of the variable dielectric substrate and therefore the electrical characteristic of the phase shifters are controlled continuously in order to achieve a desired differential phase shift between the radiating elements for a continuous beam steering, so that the antenna can be adjusted in elevation and azimuth planes.

In an embodiment the antenna comprises a plurality of power dividers and/or a plurality of electronically tunable phase shifters and/or a plurality of radiating elements. The electronically steerable phased array antenna is built as a stack of at least three dielectric materials. These materials are a front dielectric substrate (solid), a variable dielectric (solid or liquid) and back dielectric substrate (solid). One of the major advantages of the invention is that the phase shifter and all the other components are not prefabricated and assembled into a large one when an antenna is built; instead they are fabricated on large simultaneously on the three mentioned substrates.

Electronically tunable phase shifters based on planar transmission lines, preferably microstrip lines, are integrated to the antenna. The dielectric properties of the variable dielectric material, and therefore the electrical characteristics of the phase shifter can be changed by applying a bias voltage.

According to another aspect of the invention, instead of the microstrip lines, loaded lines can be used as transmission lines. Using a loaded line phase shifter, the LC layer thickness can be reduced to a few micro meters and therefore the response time is improved considerably. The planar transmission lines are also called the phase shifter electrodes or electrodes of the phase shifter.

A preferred example of an antenna constructed in accordance with the invention has 4 (2×2) radiating elements. It is a planar antenna with low profile. The antenna utilizes liquid crystal (LC) material as a variable dielectric substrate. Similar to the LC display technology, LC is sandwiched between the front and back dielectric substrates. A LC material having a maximum loss tangent of 0.05 is preferred as for example nematic LC. Other types can be used as well but performance will be poor.

According to other aspects of the present invention, the radiating elements can be grouped in order to form a sub-array. Such a sub-array comprises an input, feed network, an electronically tunable phase shifter and plurality of radiating elements. The biasing complexity of a large array antenna is reduced and antenna reliability is increased since only one phase shifter is required for each sub-array.

According to further aspects of the present invention, a low profile active phased array antenna including low noise amplifiers or transmit/receive modules can be constructed.

The demand for steerable antennas increased dramatically for mobile terminals due to the rapid development of broadcast satellite services. The invention can be used for wireless internet, multimedia and broadcasting services are provided from satellites, which operate at high frequencies of e.g. about 1-2 GHz in the L-band, or even at frequencies higher than 10 GHz as for example in the Ku-band or K/Ka-band, to a moving receiver, e.g. in a portable device or in a vehicle such as an automobile or airplane or ship by the steerable antennas. However, the antenna can be scalable for other operation frequencies as well.

BST is preferred for frequencies up to 10 GHz. LC is preferred for frequencies higher than 10 GHz due to the lower dielectric loss. Especially for high frequency operations like 77 GHz or W-band application LC is preferred according to the invention.

For a 2-D steerable antenna, if the radiating elements are grouped, only one phase shifter is required for each group. Otherwise, one phase shifter is required for one radiating element.

The challenge for the geometry of the electrodes of the phase shifter is to reduce the coupling between the electrodes, if the electrodes are meandered. Meandering the electrodes is necessary where the area where the phase shifters are fabricated is limited. Different shapes can be used theoretically. However, the preferred geometry is the spiral geometry since it improves the performance. With spiral geometry the output port is in the middle. This is an advantage when the phase shifter is integrated to the antenna.

In addition the preferred geometry of the corners of the spiral phase shifters are rounded in order to reduce the metallic losses.

A phase shifter is device which changes the signal phase and has a flat phase response over the frequency. LC based phase shifters usually have frequency dependent phase response, however it is also possible to integrate flat phase response into a LC based phase shifter and use this type in an antenna according to the invention. In another embodiment of the invention the phase shifter is a time delay unit. A time delay unit is a structure that provides a specific time delay, or programmable time delay, using a multi-path structure. Also in time delay units the preferred geometry of the delay lines is spiral geometry.

The length and the width of the antennas are independent of the technology and therefore they are more or less constant depending on the frequency. Theoretically, the distance between two radiating elements is $\lambda/2$ where $\lambda$ is the wavelength of the radiation emitted resp. received. If there is a number of "N×N" radiating elements, with "N" being an integer, preferably in the range from 10 to 100 the size of the antenna is $N(\lambda/2)\times N(\lambda/2)$ for the length and width. However, its thickness depends on the technology. Using LC according to the invention one can easily build a thin antenna array. This is similar to the LC displays or monitors.

The length and the width of the antennas are related with the antenna gain. Table 1 shows possible antenna sizes and the corresponding antenna gains of a microstrip patch antenna operating at 20 GHz. The theoretical values are given in parentheses and the ones without the parentheses are the practical values. Latter is more than the former because some space is need for the sealing, LC filling, bias pads.

TABLE 1

| Exemplary embodiments | | |
|---|---|---|
| Antenna | | |
| No. of Elements | Size | Gain |
| 8 × 8 | 10 cm × 10 cm (6 cm × 6 cm) | 21 dB |
| 16 × 16 | 15 cm × 15 cm (12 cm × 12 cm) | 27 dB |
| 32 × 32 | 30 cm × 30 cm (24 cm × 24 cm) | 35 dB |

These antennas have a preferred thickness of, but not limited to, 1.5 mm and can e.g. be reduced to 0.7 mm.

The advantages of the invention are the cost-efficiency, the high geometry efficiency based on the spiral geometry of the phase shifter electrodes, and the high compactness and low profile of the antenna, which is continuously steerable.

The antenna according to the invention consists of at least 3 substrate layers:

a uniform front dielectric substrate carrying electrodes on both sides;

a plurality of radiating elements on the top side of the front dielectric substrate;

a ground electrode with a plurality of openings covering the bottom side of the front dielectric substrate;

a plurality of planar transmissions line integrated to the ground electrode;

a uniform variable dielectric being either liquid or solid;

a back dielectric substrate having an electrically conductive layer on the top side;

a plurality of electrically conducting electrodes with different conductivities on the top side of the back dielectric substrate.

In a preferred embodiment the front and back dielectric substrates comprise mechanically stable, low loss substrates for example glass substrates, fused silica, ceramic substrates and ceramic thermoset polymer composites.

The front and the back dielectric substrate can be held apart for example by a punched out sheet forming cavities for the liquid dielectric material or by spherical spacers.

The vertical interconnects can be made by vias through the substrates.

In an embodiment the feed network can be distributed over a stack of substrates attached to the three top substrates.

The geometry of the electrodes of each element can be different from element to element. The preferred phased array antenna is a patch antenna, also called a microstrip antenna or a microstrip patch antenna. In a preferred embodiment the opening on the ground electrode underlies the radiating element.

Preferable the radiating element and the opening on the ground electrode are centered.

The planar transmission line integrated on the ground electrode comprises microstrip line, coplanar waveguide, slotline and/or stripline.

The variable dielectric substrate can be a liquid variable dielectric substrate, preferable a liquid crystal material and/or a solid dielectric material as barium strontium titanate. This means that the substrate layer can be a combination of both materials.

The liquid tunable substrate may be doped with compounds like carbon nanotubes, ferroelectric or metallic nanocomponents.

The bottom side of the front dielectric and/or the top side of the back dielectric can be coated fully or locally with an alignment layer in order to pre-orient the liquid variable dielectric material.

The electrically conductive layer on the top of the back dielectric substrate is preferred a planar transmission line which is an electronically tunable phase shifter.

The electronically tunable phase shifter may be electromagnetically coupled to the radiating elements.

In an embodiment the contactless RF interconnection utilizes the electromagnetic coupling of the RF signal between identical or different transmission lines which are mounted on different layers.

The electrically conductive layer can comprise high conductive electrodes including Gold and Copper.

The transmission line in a preferred embodiment is a microstrip line. The microstrip line is preferable meandered regularly or irregularly and especially the microstrip line is in spiral shape.

In an embodiment the dielectric constant of the variable dielectric substrate and therefore the electrical characteristics of the phase shifter are changed by applying a voltage across the planar transmission line and the ground electrode through a bias line in order to achieve a desired differential phase shift between the radiating elements for beam steering.

The bias line can comprise electrically low conductive electrode material including indium tin oxide or chromium or nickel-chromium alloy.

In an embodiment in addition a thin film transistor circuit is implemented on the upper side of the back substrate.

The electronically tunable phase shifter can include loaded line phase shifters, wherein the planar transmission line is loaded periodically or non-periodically by the varactors, whereas the varactors can be loaded shunt or serial to the planar transmission line. Also here the planar transmission line can comprise microstrip line, coplanar waveguide, slotline and/or stripline. The dielectric constant of the variable dielectric substrate and therefore the load of the varactor can be changed by applying a bias voltage trough an electrically low conductive bias line in order to control the electrical characteristics of the loaded line phase shifter for beam forming.

In a preferred embodiment the radiating elements can be grouped in order to form a sub-array. In this case the radiating elements in the sub-array can be fed through a common electrically tunable phase shifter. Especially the sub-array comprises 2×2 radiating elements.

In an embodiment the antenna has a two stacked dielectric substrates having electrically conductive layers on the bottom sides instead of the front dielectric substrate wherein the solid dielectric substrates can comprise thin substrates including Kapton Folio, liquid crystal polymer and Mylar Folio. The radiating elements can be mounted on the bottom side of the thin dielectric substrate. The ground electrode with openings and a planar transmission line can be mounted on the bottom side of the second dielectric substrate.

In another embodiment the antenna comprises an electrically conductive layer on the bottom side of the back dielectric substrate; a low noise amplifier (LNA) and/or a transmit/receive module (TRM) placed on the bottom side of the back dielectric substrate, wherein the radiating elements can be grouped and utilize a common LNA. The LNA can be placed either between or after the radiating element and the phase shifter.

For the operation of the inverted microstrip line (IMSL) phase shifter (delay line), the LC material underlying the phase shifter electrodes 111 is required. This is the minimum requirement. In the preferred embodiment LC is filled in between two glass substrates. This works as well but it is not necessary. Wells or pools in which LC is filled are sufficient.

BRIEF DESCRIPTION OF THE DRAWINGS

FIGS. 4*a*, 4*b* and 4*c* are schematic representations of three layouts of the steerable phased array antenna according to the embodiment of the present invention given in FIG. 2;

FIGS. 5*a*, 5*b* and 5*c* are photos of a realized phased array antenna according to the embodiment of the present invention given in FIG. 4;

DETAILED DESCRIPTION OF THE INVENTION

In the following, a detailed description is given according to one possible embodiment of the present invention. The embodiment is not dedicated to present every features of the invention instead it provides a basic understanding of some aspects of the invention. It is a two-dimensional steerable antenna which can be used either in receiving or transmitting mode since it is a passive and reciprocal antenna. However, most of the description is given only for a receiving antenna in order to explain the invention in a clear way. The illustrations and relative dimensions may not necessarily be scaled in order to illustrate the invention more efficiently.

Figure 1:
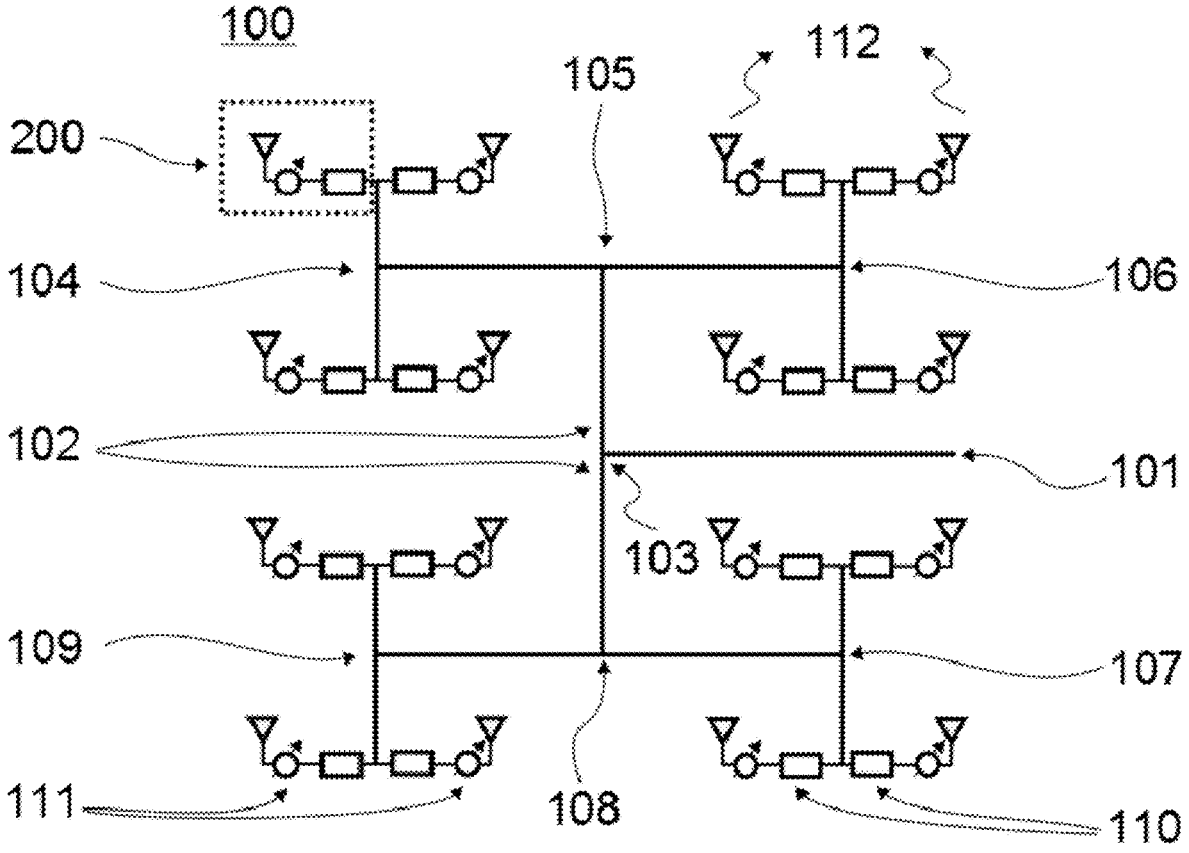
FIG. 1 is a block diagram of an example of a two dimensional, electronically steerable phased array antenna according to the present invention.

Referring to the drawings, FIG. 1 is a block diagram of an electronically steerable phased array antenna 100 according to the present invention. The phased array antenna includes signal input port 101 for example a RF signal input port, feeding network 102, plurality of power combiners 103-109, plurality of DC block structures 110, plurality of electronically tunable phase shifters 111 and plurality of radiating elements 112.

In another embodiment (not shown) the feeding network is on another substrate.

The feeding network 102 may include plurality of transmission lines with different electrical length and characteristic impedance in order to provide the impedance matching between the radiating elements 112 and input port 101. The power combiners 103-109 may combine the power equally or unequally and deliver it to antenna unit element 200 for a desired radiation pattern. According to the antenna theory the distance between the radiating elements 112 is about 0.5 to 0.8 times of the wavelength in vacuum. A lower distance results in high electromagnetic coupling between the elements and a higher distance leads to a grating lobes in the radiation pattern.

Figure 2A:
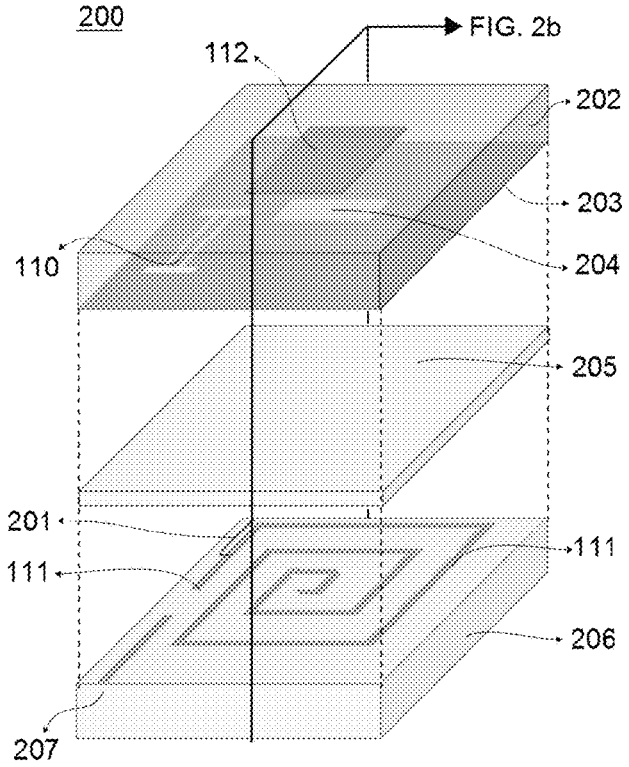
FIGS. 2*a* and 2*b* are exploded and side views of a unit element of the electronically steerable antenna according to an embodiment of the present invention.
Figure 2B:
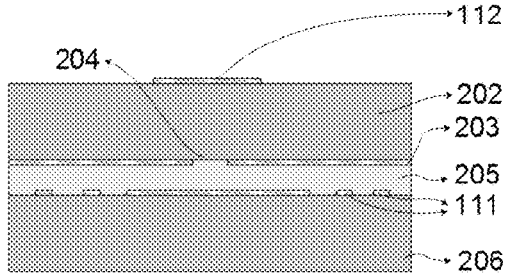

FIGS. 2*a* and 2*b* show exploded and side views of a unit element 200 of the electronically steerable antenna according to an embodiment of the present invention. The unit element 200 includes a radiating element 112, a tunable phase shifter 111, a DC blocking structure 110 and a bias line 201 in order to apply a bias voltage to the electronically tunable phase shifter 111. These components are placed on three dielectric layers, namely front dielectric substrate 202, tunable dielectric substrate 205 and back dielectric substrate 206.

A radiating element 112 is mounted on the top side of a low loss, front dielectric substrate 202.

As shown here, the radiating element 112 may be a rectangular patch antenna which can be used for different polarizations. In other embodiments the radiating element 112 is a circular, a square patch or any other kind of patch with a slot. A rectangular or square patch can also be cut from one or more corners. It is made of an electrically high conductive electrode. The bottom side of the front dielectric substrate 202 is covered with electrically conductive electrode which forms a ground electrode 203 for the radiating element 112. The ground electrode 203 includes a slot 204 overlying the antenna element 112. An aperture coupling is formed via the slot 204 in order to couple the RF signal between the radiating element 112 and the phase shifter 111. The ground electrode 203 also includes a coplanar waveguide (CPW) which is a part of the DC blocking structure 110.

The preferred embodiment the signal is coupled between the different transmission lines. In another embodiment the signal is coupled capacitively. This means there are two patches, whereas one is mounted on the bottom side of the front dielectric substrate and the other is placed on the top side of the back dielectric substrate, like a parallel plate capacitor.

A tunable dielectric substrate 205 is encapsulated between the front dielectric substrate 202 and a back dielectric substrate 206. A cavity between these two dielectrics 202, 206 is required when the tunable dielectric substrate 205 is liquid. Such a cavity can be accomplished by using appropriate spacers. The mechanical stability of the front and back dielectrics 202, 206 is significant in order to maintain a uniform cavity height. The cavity height can be in the range of a 1 μm . . . 3 μm to several hundred milli-meters depending on the phase shifter topology. For a microstrip line based phase shifters a higher cavity height corresponds to a higher dielectric thickness and therefore the metallic losses are reduced. However, when a liquid crystal material is utilized, the device response time will be relatively longer due to a thick LC layer. On the other hand, the LC cavity height can reduced to 1 μm . . . 50 μm when a loaded line phase shifter is used. In the embodiment of the invention IMSL phase shifter is used. As a compromise between the metallic loss and phase shifter response time a cavity height of about 100 μm is preferred. However, the height can be reduced or increased according to the aforementioned range. If the height is reduced it lets to an increase of the metallic loss, if it is decreased it lets to a reduction of the metallic loss.

In operation of a unit element 200, the RF signal received by the radiating element 112 is coupled to the microstrip line 111, via the aperture coupling which is formed by a slot 204 on the ground electrode 203. The dielectric properties of the variable dielectric substrate 205, and therefore the phase of the RF signal can be changed by applying a bias voltage across the ground electrode 203 and microstrip line 111 through a bias line 201. The bias line 201 is an electrically low conductive electrode, compared to the electrode of the phase shifter 111. The signal is then electromagnetically coupled to the CPW on the ground electrode 203 which is mounted on the bottom side of the front dielectric substrate 202. After propagating along a short CPW line, the RF signal is coupled to the unit element input port 207. By this way, a contactless RF interconnection as a DC blocking structure 110 is achieved between the phase shifter 111 and the unit element input port 207. The variable dielectric substrate 205 is tuned only underneath the microstrip line 111 because the biasing voltage can not affect the rest of the antenna, i.e. other unit elements, due to the DC blocking 110.

In operation of a unit element 200 for a transmitting mode, the transmitting signal received from the array feed network is first electromagnetically coupled from the unit element input port 207 to the CPW on the ground electrode 203. After propagating along a short CPW line, the signal is coupled to the microstrip phase shifter 111. By this way, a contactless RF interconnection as a DC blocking structure 110 is achieved between the phase shifter 111 and the unit element input port 207. The dielectric properties of the variable dielectric substrate 205, and therefore the phase of the transmitted signal can be changed by applying a bias voltage across the ground electrode 203 and microstrip phase shifter 111 through a bias line 201. The bias line 201 is an electrically low conductive electrode, compared to the electrode of the phase shifter 111. After propagating along the microstrip line 111, the signal is coupled to the radiating element 112 by which it is radiated. The coupling between the phase shifter 111 and the radiating element 112 is accomplished via the aperture coupling which is formed by a slot 204 on the ground electrode 203.

The DC blocking structure 110 utilizes the electromagnetic coupling between the similar or different transmission lines mounted on the different layers. It has to be mentioned that the coupling between CPW and microstrip line according to the embodiment is an example of one of the aspects of the present invention. Such a structure can also be optimized so that it may work as a RF filter. The challenge is to suppress the undesired radiation which can affect the antenna radiation characteristic and this can be solved by using an electromagnetic solver.

Electrically tunable phase shifter 111 is fabricated in, but not limited to, inverted microstrip line topology. A microstrip line 111, preferably in spiral shape, is mounted on the top of the back dielectric substrate 206. Its ground electrode 203 is mounted on the bottom side of the front dielectric substrate 202. The electrical properties of such a transmission line can be changed since its dielectric material is a tunable dielectric substrate 205.

Liquid crystal (LC) material can be used as a tunable dielectric substrate 205 at micro- and milli-meter wave frequencies. LC is an anisotropic material with low dielectric losses at these frequencies. Effective dielectric constant of LC for RF field depends on the orientation of the molecules. This property can be exploited to control the wavelength, and thus the phase of an electromagnetic wave, by changing the orientation of LC. The orientation of the molecules can be varied continuously by using an external electric or magnetic field, using a surface alignment of liquid crystal or a combination of these methods.

In another embodiment (not shown) the antenna might consist of a stack of more layers, including more than one LC layer substrates which are separated with at least one layer of solid substrates.

Figure 3:
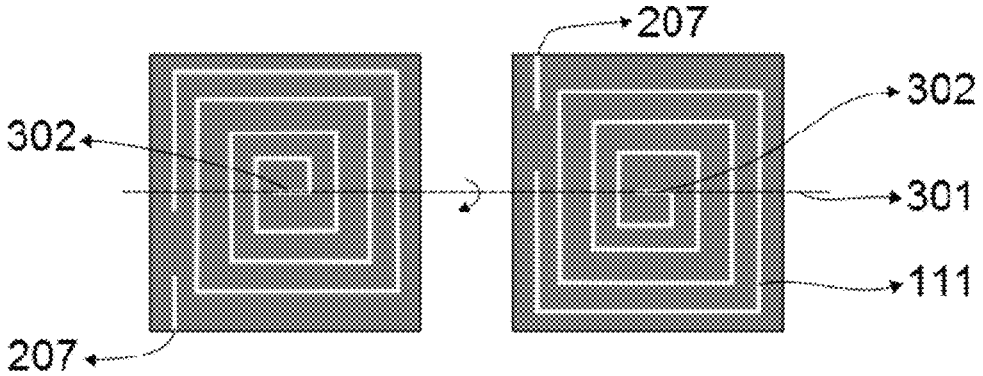
FIG. 3 is a schematic representation of a layout of a spiral shape phase shifter.

A tunable phase shifter having a differential phase shift of 360° has to be designed in a limited area which is the area of one unit element. The maximum achievable phase shift is frequency dependent and requirements can be adjusted by setting the length of the phase shifter. Due to the limited area, the phase shifter has to be meandered in order to achieve a desired length. Meantime, the coupling between the transmission lines has to be prevented. According to the present invention, the phase shifter is implemented in spiral shape as shown in FIG. 3. Such a phase shifter has 5% to 15% more differential phase shift compared to a meander transmission line, when identical design rules are used and when it is integrated to a radiating element. Additionally, due to the spiral shape, the coupling of RF signal between the phase shifter and the radiating element is accomplished in the centre of the unit element. When the phase shifter 111 is flipped along the axis 301, the unit element input port 207 shifts to the other side whereas the coupling point 302 is still in the centre. This allows flipping the phase shifters in order to design a compact feeding network. Simultaneously, the distance between the radiating elements is kept constant which is crucial for the antenna radiation characteristic. The shape of the phase shifter is not limited to the spiral shape. Its shape can be optimized in order to design compact, high performance phase shifters which can be integrated the antenna array.

According to another aspects of the invention, loaded line phase shifters can be integrated to the antenna array. Within this approach, a non-tunable transmission line is loaded periodically or non-periodically with varactor loads. The varactors can be loaded either serial or shunt to the transmission line.

FIG. 4 illustrates three layouts of a two dimensional, electronically steerable phased array antenna according to the embodiment of the present invention given in FIG. 2. The antenna includes, but not limited to, 16 (4×4) radiating elements 112 which are mounted on the top of the front dielectric 202.

The bottom side of the front dielectric substrate 202 is covered with ground electrode 203 which includes the CPW line segments 110 and the slots 204 for DC blocking structure and aperture coupling, respectively.

The RF signal input port 101, feeding network 102, plurality of power combiners 103, plurality of electronically tunable phase shifters 111, plurality of bias lines 201 and plurality of biasing patches 402 are placed on the top side of the back dielectric substrate 206. A tunable dielectric which is not shown here is in contact with the ground electrode 203 and the top side of the back dielectric substrate 206. The layers can be aligned accurately by using complementary alignment marks 401. The back dielectric layer 206 is enlarged compared to the front dielectric layer 202 from the sides where contacts for RF input port 101 and biasing patches 402 are required.

FIG. 5 illustrates the top, side and bottom view photos of a two dimensional, electronically steerable antenna prototype according to the embodiment of the present invention given in FIG. 4.

The antenna includes four radiating elements. Overall height of the prototype is 1.5 mm including the front, tunable and back dielectric substrates.

FIG. 6 illustrates a unit sub-array element of a phased array antenna according to another embodiment of the present invention. The unit sub-array element 700 includes, but not limited to, 2×2 radiating elements 112 on the top side of the front dielectric substrate 202. The ground electrode 203, slots 204 and the DC blocking structure 110 are mounted on the bottom side of the front dielectric substrate 202. An electrically tunable phase shifter 111, a power combiner 103 and a bias line 201 are fabricated on the top side of the back dielectric substrate 206. A tunable dielectric which is not shown here is in contact with the ground electrode 203 and the top side of the back dielectric substrate 206.

In operation, the RF signal received by the radiating elements 112 is coupled to the power combiner 103 via the aperture coupling 204. The power combiner 103 delivers the signal to the phase shifter 111 which surrounds the power combiner 103. The electrical characteristics of the tunable dielectric substrate and therefore the phase of the RF signal are controlled by applying a bias voltage.

Such a bias voltage is applied through the bias line 201 across the ground electrode 203 and the phase shifter 111. The RF signal is then coupled the sub-array input port 207 via the DC blocking structure 110.

Required numbers of phase shifter and biasing lines are reduced by a factor of radiating element number in the sub-array architecture since all radiating elements are fed through one electronically tunable phase shifter. Similarly, an active phased array antenna requires less number of amplifiers. Due to that, the antenna becomes cost effective and reliable. Concerning the antenna radiation pattern, a differential phase shift between the radiating elements has to be satisfied in order to tilt the radiated phase front. In case of sub-array architecture, this requirement is accomplished for each sub-array. According to the antenna theory the distance between the sub-arrays is about 0.5 to 0.8 times of the wavelength in vacuum.

This reduces the spacing between the radiating elements and therefore, the antenna aperture efficiency is increased. However, the mutual coupling between the radiating elements increases as well. For such an antenna, an optimization process is necessary between the antenna radiation characteristic and cost effectiveness, reliability and biasing complexity when defining sub-array architecture, i.e. radiating element number.

Figure 7A:
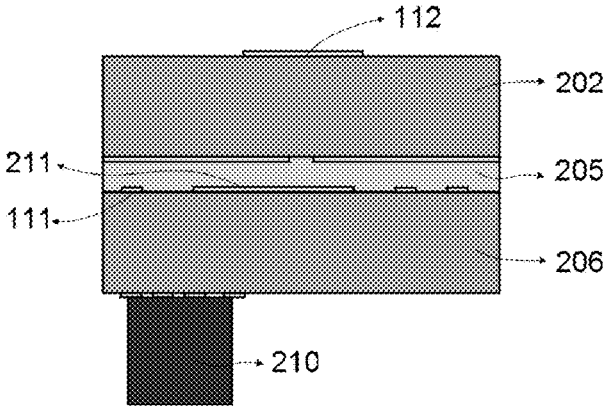
FIGS. 7*a* and 7*b* are side views of a unit element and a unit sub-array element of an active phased array antenna according to another embodiment of the present invention.
Figure 7B:
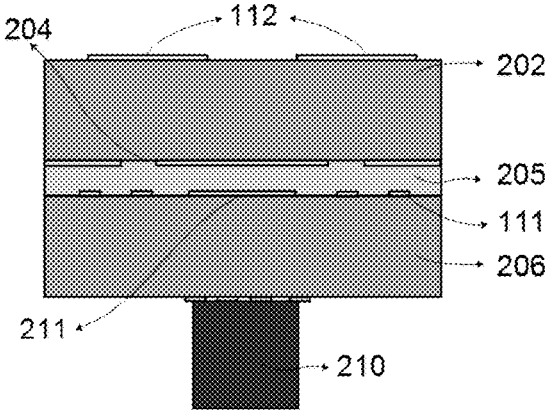

FIGS. 7*a* and 7*b* illustrate the side views of a unit element and a unit sub-array element of an active phased array antenna according to another embodiment of the present invention. A low noise amplifier (LNA) 210 is mounted on the bottom side of the dielectric substrate 206. The RF signal received by the radiating element 112 is coupled to a transmission line 211 which is located on the top side of the back dielectric substrate 206. The signal is then coupled to a LNA 210 which is placed on the bottom side of the back dielectric substrate 206. After amplifying, the RF signal is coupled to the tunable phase shifter 111 which has a tunable dielectric substrate 205. By this way, the noise of the components affecting the antenna noise figure is suppressed and therefore antenna noise level is reduced.

The invention has been described in details by means of embodiments. Any changes and modifications of the embodiments are limited by the scope of the following claims.

The realization of an embodiment is explained here:

Realization of a LC based inverted microstrip line (IMSL) phase shifter is shown in FIG. 2. A seed layer made of chromium/gold layer is evaporated on a low loss dielectric substrate. The chromium (Cr) layer has a thickness of 5 nm and is utilized as an adhesive layer between the substrate and the 60 nm thick gold layer. A photoresist (PR) is applied on the seed layer which is then exposed and developed. The electrodes of the structures are formed by electroplating of 2 μm thick gold. After the plating, the PR is removed and the seed layer is etched and therefore only the plated electrodes exist on the substrate. The substrate is diced precisely, i.e. ±5 μm, into two pieces. Each piece is coated with an alignment layer and rubbed mechanically in order to form grooves on the surface. The substrates are then aligned using alignment marks and bonded using glue. LC is filled between the substrates and therefore, appropriate spacers, i.e. micro pearls, are developed on the substrates after the rubbing. Finally, LC is filled and the structure is sealed by which the material is encapsulated between the two substrates. The mechanical stability of the substrates is significant in order to maintain a uniform cavity height. Hence, a low loss glass or ceramic dielectric substrate is preferred for the fabrication.

An embodiment is described here:

A microstrip patch antenna is mounted on the top side of the front dielectric. The ground electrode of the patch antenna is mounted on the bottom side of the same dielectric. The ground electrode includes a slot overlying the patch (FIG. 5*c*) which form an aperture coupling between the patch antenna and the phase shifter. The strip electrode of the IMSL phase shifter is mounted on the top side of the back substrate. The LC material is encapsulated between the two substrates. It forms the dielectric of the IMSL and has thickness of 100 μm. In operation of a receiving antenna, the received RF signal is first coupled to the phase shifter. After propagating along the phase shifter, the RF signal is electromagnetically coupled to a coplanar waveguide (cpw) which is located on the ground electrode. The signal propagates along a short cpw line, and then it is coupled to the unit element input port which is placed on the top side of the back dielectric. By this way, a contactless RF interconnection as a dc blocking structure is accomplished between the phase shifter and the unit element input port.

More detailed information about further embodiments are:

The unit element is integrated with a LC based tunable phase shifter. The phase shifter has to satisfy a desired differential phase shift $\Delta\phi_b$, i.e. 360°, for an optimum beam steering. The differential phase shift of the IMSL is calculated as $$\Delta\phi_b = \frac{2\pi fl}{c_0}\left(\sqrt{\varepsilon_{r,eff,||}} - \sqrt{\varepsilon_{r,eff,\perp}}\right)$$

Whereas, f is frequency, I is physical length, $c_0$ is the speed of the light in vacuum, $\varepsilon_{r,eff,\perp}$ relative effective perpendicular permittivity, $\varepsilon_{r,eff,||}$ relative effective parallel permittivity.

The length of a phase shifter operating at 18 GHz with a $\Delta\phi_b$ of 360° is determined as $5.65\lambda_0$ using a specific type of LC. On the other hand, the size of the unit element is set to be $0.65\lambda_0 \times 0.65\lambda_0$ in order to prevent grating lobes. Hence, the phase shifter has to be designed in a compact way due to the limited area of the unit element. One possible solution is to meander the phase shifter. In this case, however, the coupling between the lines becomes an issue. It can be minimized within the simulation by optimizing the gap between the lines. The total length of the phase shifter is 75 mm and the phase shifter itself (without the transitions) utilizes an area of $0.5\lambda_0 \times 0.5\lambda_0$ at 18 GHz. This area is less than the area of the unit element. This is due to the fact that when the unit elements are combined in order to form an array, the RF feed network and the bias network require certain amount of area as well.

Figure 8:
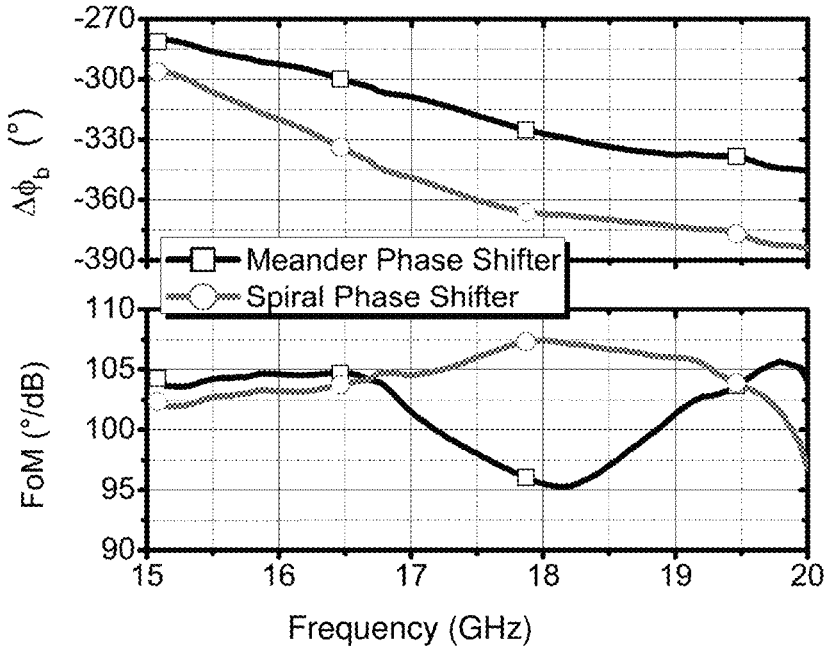
FIG. 8: Simulated $\Delta\phi_b$ and FoM of the meander and spiral phase shifters without a cpw to microstrip line transitions.

The performance and the compactness of the phase shifter can be improved further depending on its geometry. For this manner, the geometry, in which the microstrip line is meandered, is significant. One possible solution is to meander the phase shifter in spiral geometry. Such a phase shifter has several improvements compared to the meander line phase shifter. Both phase shifters are designed on the same size of area using the identical design rules, i.e. identical gap size between two electrodes. In FIG. 8, simulated $\Delta\phi_b$ and FoM results of the phase shifters are given.

As can be seen from FIG. 8, the $\Delta\Phi_b$ of the spiral phase shifter is 5% to 15% more compared to that of the meander phase shifter. Meantime, the insertion loss is kept almost constant and therefore the FoM is increased, for instance, from 95°/dB to 105°/dB at 18 GHz. Additionally, due to the spiral geometry, the coupling of the RF signal between the phase shifter and the radiating element is accomplished in the centre of the unit element. When the phase shifter geometry is flipped, the unit element input port shifts to the other side whereas the coupling point is still in the centre. This allows flipping the phase shifters in order to design a compact RF feed network. Simultaneously, the distance between the radiating elements is kept constant which is crucial for the antenna radiation characteristic.

The antenna array requires a bias network in order to tune the phase shifters independently. The voltage applied across the bias pads and the ground electrode are delivered to the RF circuitry through the bias lines. The bias lines have to be implemented using a low electrically conductive material and therefore they have negligible impact on the RF signal. Possible materials are indium tin oxide (ITO), chromium (Cr) or nickel-chromium (Ni—Cr). Although having relatively high conductivity ($\sigma$=7.8×106 S/m), the Cr adhesive layer is utilized for implementing the bias lines. It has a thickness of 5 nm which results in a sheet resistance of 25:3=sq. The line width is set to be 10 μm in order to increase the bias line resistance.

The 2D-antenna can also be 3D in structure, e.g. it can be wrapped around an object.

DESCRIPTION OF THE REFERENCE NUMBERS

FIG. 1: Block diagram of an example of a two dimensional, electronically steerable phased array antenna according to the present invention FIGS. 2*a* and 2*b*: Exploded and side views of a unit element of the electronically steerable antenna according to an embodiment of the present invention FIG. 3: Schematic representation of a layout of a spiral shape phase shifter FIGS. 4*a*, 4*b* and 4*c*: Schematic representations of three layouts of the steerable phased array antenna according to the embodiment of the present invention given in FIG. 2

FIGS. 5*a*, 5*b* and 5*c*: Photos of a realized phased array antenna according to the embodiment of the present invention given in FIG. 4

Figure 6A:
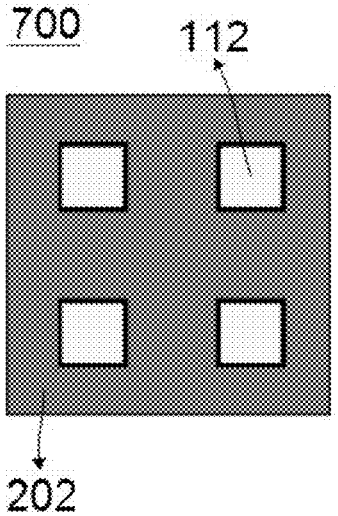
FIGS. 6*a*, 6*b* and 6*c* are schematic representations of three layouts of the steerable phased array antenna according to another embodiment of the present invention.
Figure 6B:
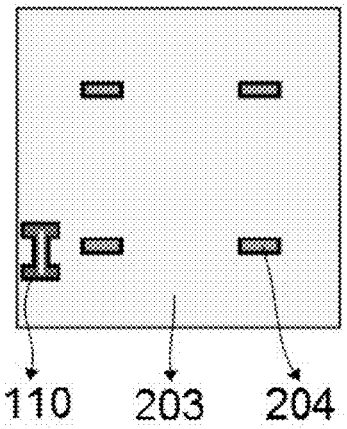
Figure 6C:
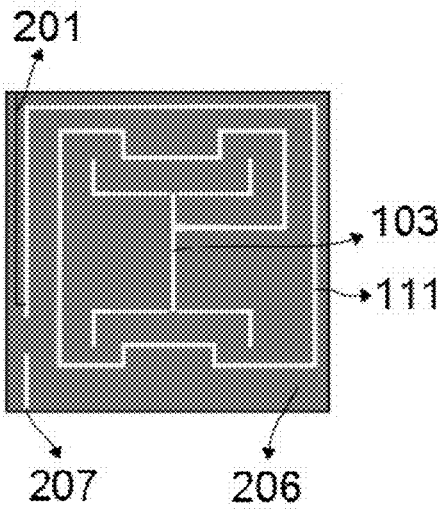

FIGS. 6*a*, 6*b* and 6*c*: Schematic representations of three layouts of the steerable phased array antenna according to another embodiment of the present invention FIGS. 7*a* and 7*b* Side views of a unit element and a unit sub-array element of an active phased array antenna according to another embodiment of the present invention FIG. 8: Simulated $\Delta\Phi_b$ and FoM of the meander and spiral phase shifters without a cpw to microstrip line transitions.

100 Electronically steerable phased array antenna
101 Signal input port
102 feeding network
103-109 power combiners
110 DC blocking structure
111 phase shifters electrodes
112 radiating element
200 Antenna unit element
201 bias line
202 front dielectric substrate
203 ground electrode
204 slot/aperture coupling
205 tunable dielectric substrate
206 back dielectric substrate
207 unit element input port
210 low noise amplifier (LNA)
211 Transmission line
301 flip axis
302 coupling point
401 alignment marks
402 biasing patch
700 unit sub-array element

The invention claimed is:

1. A planar continuously steerable phased array antenna comprising:

at least three substrate layers from top to bottom;
a solid front dielectric substrate layer,
an electronically variable dielectric layer, and
a solid back dielectric substrate layer, wherein said electronically variable dielectric layer is in-between said front and back dielectric substrate layers;

at least one phase shifter including electrodes mounted on a top of the back dielectric substrate layer;

at least two radiating elements;

a feeding network for providing the impedance matching between the radiating elements and a signal input port; and at least one biasing line that controls the electrical characteristics of the electronically variable dielectric layer and therefore the phase of the RF signal by applying a bias voltage, wherein the radiating elements are located on the top side of the front dielectric substrate layer, wherein the phase shifters having the electrodes are integrated into the antenna and are electronically tunable by utilizing the electronically variable dielectric layer, and whereby the electrodes of the phase shifters are planar transmission lines that feed the signal to the radiating elements.

2. A phased array antenna according to claim 1, whereas the phase shifter electrodes are meandered regularly or irregularly.

3. A phased array antenna according to claim 1, whereas the phase shifter electrodes are arranged spirally.

4. A phased array antenna according to claim 1, whereas at least two phase shifters build a sub-array.

5. A phased array antenna according claim 1, whereas at least four phase shifters build a sub-array.

6. A phased array antenna according to claim 5, whereas the input feed is in the midst of the sub-array.

7. A phased array antenna according to claim 1, further comprising a plurality of sub-arrays.

8. A phased array antenna according to claim 1, where the phase shifter is a time delay unit.

9. A phased array antenna according to claim 1, wherein the electronically tunable phase shifter includes one or more loaded line phase shifters.

10. A phased array antenna according to claim 1, wherein the front and back dielectric substrates comprise mechanically stable, low loss substrates.

11. A phased array antenna according to claim 1, wherein at least one layer selected from the two substrates and the dielectric layer consists of a uniform material.

12. A phased array antenna according to claim 1, whereas the electronically variable dielectric layer of the phase shifter is a liquid crystal.

13. A phased array antenna according to claim 1, where the phase shifters are integrated to the radiating elements and feeding network.

14. A phased array antenna according to claim 1, where the phase shifters are electromagnetically coupled to the radiating elements.

15. A phased array antenna according to claim 1, wherein the bias voltage is applied to one of the electrodes of the phase shifter through a bias line.

16. A method for operating the phased array antenna according to claim 1, the method comprising:

receiving the RF signal at a radiating element of the at least two radiating elements;

changing the phase of the RF signal by applying the bias voltage across a ground electrode and the at least one phase shifter through the biasing line, wherein the at least one phase shifter is coupled to the radiating element by an aperture coupling and includes electrodes mounted on a top of the back dielectric substrate layer; and coupling the RF signal to the ground electrode having a coplanar waveguide; and coupling the RF signal to an input port to create a contactless RF interconnection between the at least one phase shifter and the input port.

17. A device comprising one or more phased array antennas according to claim 1.

18. A phased array antenna according to claim 1 comprising:

a plurality of individual antenna elements, a feed network, and a biasing network.

* * * * *